US006097673A

United States Patent [19]

Hillis

[11] Patent Number: 6,097,673

[45] Date of Patent: Aug. 1, 2000

[54] GROOVED PLANE FOR CONGREVE-STYLE CLOCK

[75] Inventor: W. Daniel Hillis, Toluca Lake, Calif.

[73] Assignee: The Long Now Foundation, Sausalito, Calif.

[21] Appl. No.: 09/167,404

[22] Filed: Oct. 6, 1998

[51] Int. Cl.[7] ..... G04B 19/00; G04C 21/00

[52] U.S. Cl. ..... 368/62; 368/76

[58] Field of Search ..... 368/62, 76, 93, 368/223

[56] References Cited

U.S. PATENT DOCUMENTS

| | | | |
|---|---|---|---|
| 3,538,851 | 11/1970 | Korr . | |
| 4,077,198 | 3/1978 | Mayenschein | 368/76 |
| 4,370,064 | 1/1983 | Hicks et al. | 368/93 |

FOREIGN PATENT DOCUMENTS

| | | |
|---|---|---|
| 3164 | 9/1808 | United Kingdom . |
| WO 9012345 | 10/1990 | WIPO . |

*Primary Examiner*—Vit Miska

*Attorney, Agent, or Firm*—Michael A. Glenn

[57] ABSTRACT

A design is for a Congreve-style clock that keeps time more accurately, i.e. that is insensitive to minor variations in friction on the ball, in which the depth of each groove in the inclined plane varies along its length so that the path of the ball approximates a cycloid on each traversal. The grooves provide alternating paths that overlap such that the distance that the ball travels varies with the speed of the ball. In such system, increased friction causes the ball to move more slowly, but because the slower ball also follows a shorter path, the time required to reach the bottom of the inclined plane remains the same. Similarly, decreased friction causes the ball to travel more quickly, but a faster moving balls takes a longer path.

9 Claims, 3 Drawing Sheets

GROOVED PLANE FOR CONGREVE-STYLE CLOCK

BACKGROUND OF THE INVENTION

TECHNICAL FIELD

The invention relates to clocks. More particularly, the invention relates to Congreve-style clocks.

DESCRIPTION OF THE PRIOR ART

In August of 1808 William Congreve received British patent no. 3164 for "A New Principle of Measuring Time and Constructing Clocks and Chronometers." Congreve's invention was a clock (see FIG. 1) that used a ball rolling down an inclined plane as a timing element. The design has proved popular, in part because the rolling ball provided an attractive visual display. Experience has shown, however, that clocks following the Congreve design keep time poorly, at least in part because the timing is sensitive to minor variations in friction on the ball. For example, the ball in a typical design travels 7–¼ miles per day—2646 miles in a year. Even a slight amount of friction can affect timing for a ball travelling such a long path.

In the Congreve design, the rolling ball follows a series of grooves cut into the plane at a fixed depth. The grooves connect at the ends, creating a zigzag path down the inclined plane (see FIG. 2). Thus, the ball follows a series of straight line paths alternating back and forth across the plane. In such system, increased friction on the ball causes the ball to move more slowly and take a longer time to traverse the path.

It would be advantageous to provide a design for a Congreve-style clock that keeps time more accurately, i.e. that is insensitive to minor variations in friction on the all.

SUMMARY OF THE INVENTION

The invention provides a design for a Congreve-style clock that keeps time more accurately, i.e. that is insensitive to minor variations in friction on the ball. In the preferred embodiment of the invention, the depth of each groove in the inclined plane varies along its length so that the path of the ball approximates a cycloid on each traversal. The grooves provide alternating paths that overlap such that the distance that the ball travels varies with the speed of the ball. In such system increased friction causes the ball to move more slowly, but because the slower ball also follows a shorter path, the time required to reach the bottom of the inclined plane remains the same. Similarly, decreased friction causes the ball to travel more quickly, but a faster moving balls takes a longer path.

DETAILED DESCRIPTION OF THE INVENTION

The invention provides a design for a Congreve-style clock that keeps time more accurately, i.e. that is insensitive to minor variations in friction on the ball. In the preferred embodiment of the invention, the depth of each groove in the inclined plane varies along its length so that the path of the ball approximates a cycloid on each traversal. For purposes of the discussion herein, a cycloid shall mean the curve traced out by a point on a circle rolling along a straight line, for example a point on the rim of a wheel rolling along the ground. For a circle of radius r along a horizontal axis, the cycloid produced is a series of continuous arcs that rises from the axis to a height $2\pi$ and falls to touch the axis again at a cusp point, where the next arc begins. The horizontal distance between successive cusps is $2\pi r$, the circumference of the circle. The length of the cycloid between adjacent cusps is 8r. If $\theta$ is the angle formed by the radius to a point P(x,y) on the cycloid and the radius to the point of contact with the x-axis, the parametric equations of the cycloid are:

$$x=r(\theta-\sin\theta) \tag{1}$$

$$y=r(1-\cos\theta) \tag{2}$$

Figure 1:
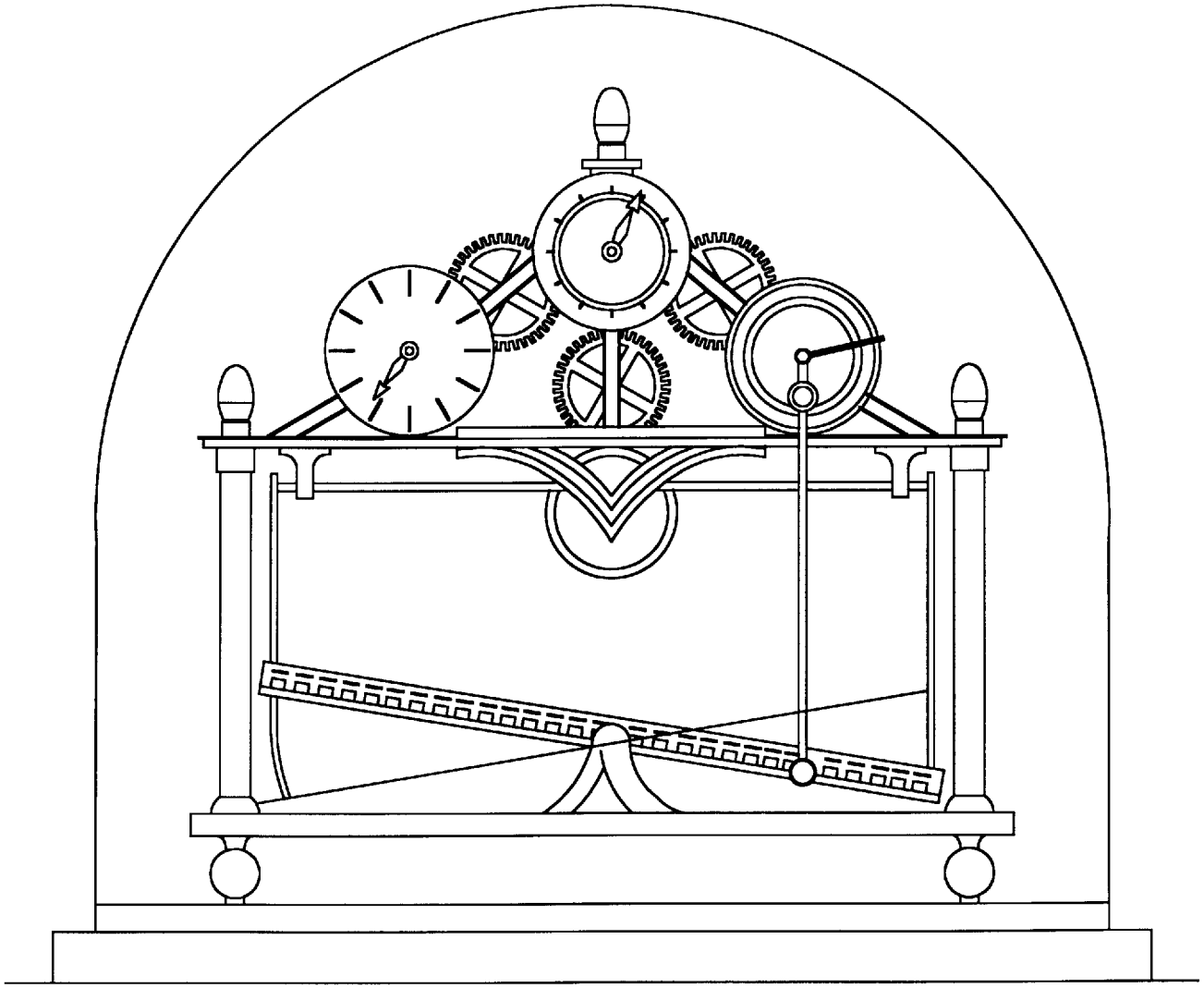
FIG. 1 (PRIOR ART)
FIG. 1 is a front view of a Congreve-style clock.
Figure 2:
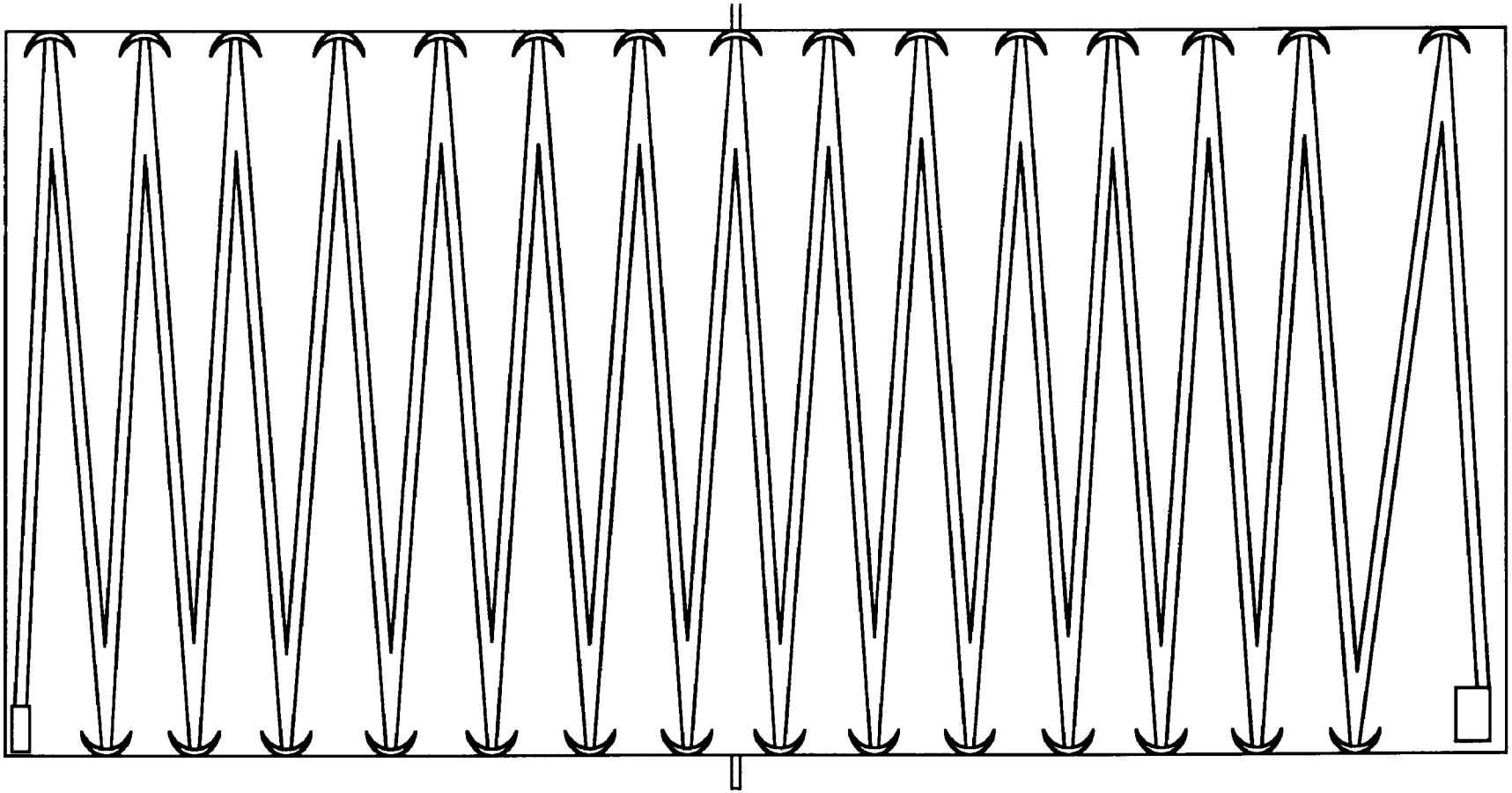
FIG. 2 (PRIOR ART)
FIG. 2 is a plane view of a grooved, inclined plane for a Congreve-style clock.
Figure 3:
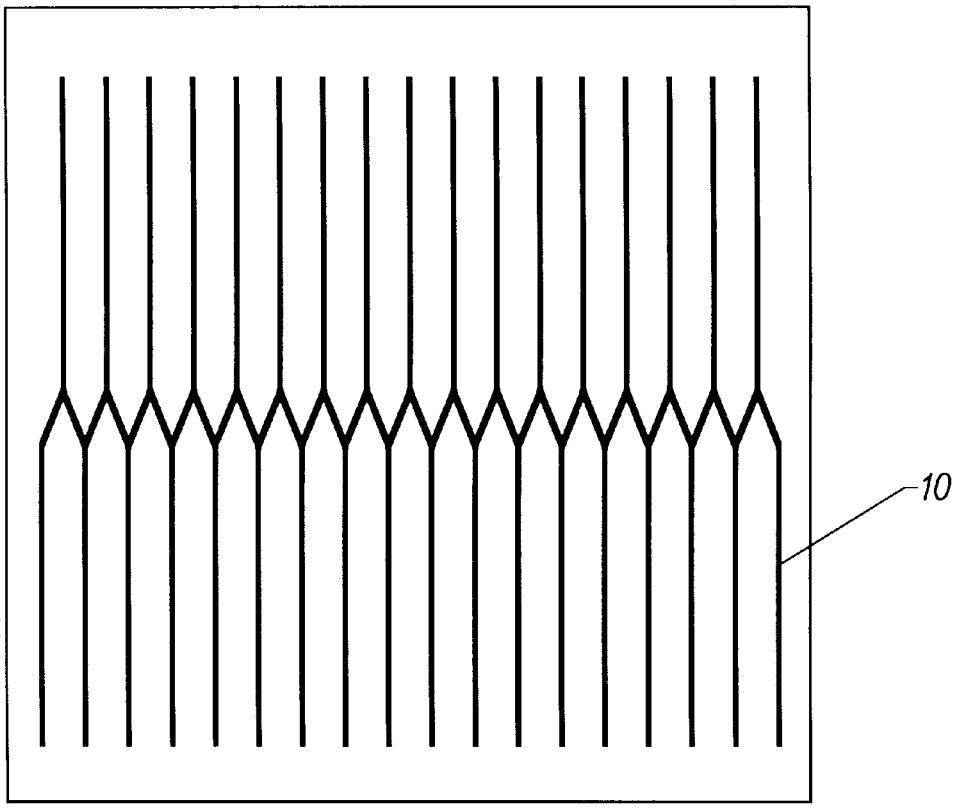
FIG. 3 is a plane view of a grooved, inclined plane for a Congreve-style clock according to the invention.
Figure 4:
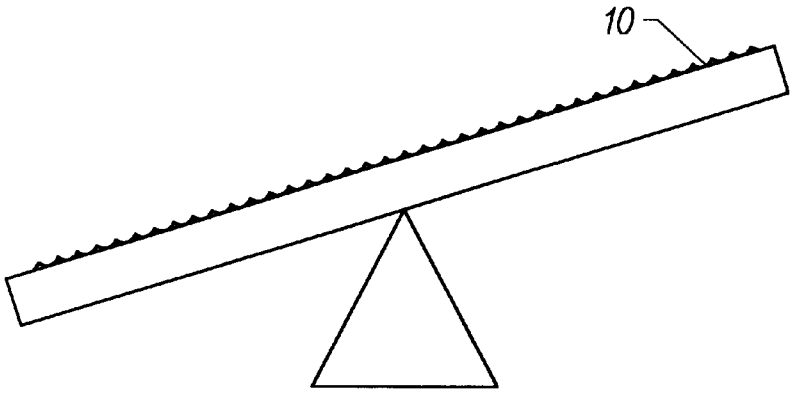
FIG. 4 is a side view of a grooved, inclined plane for a Congreve-style clock according to the invention.

FIG. 3 is a plane view of a grooved, inclined plane for a Congreve-style clock according to the invention and FIG. 4 is a side view of a grooved, inclined plane for a Congreve-style clock according to the invention. The grooves 10 provide alternating paths that overlap such that the distance that the ball travels varies with the speed of the ball. In such system, increased friction causes the ball to move more slowly, but because the slower ball also follows a shorter path, the time required to reach the bottom of the inclined plane remains the same. Similarly, decreased friction causes the ball to travel more quickly, but a faster moving balls takes a longer path.

Figure 5:
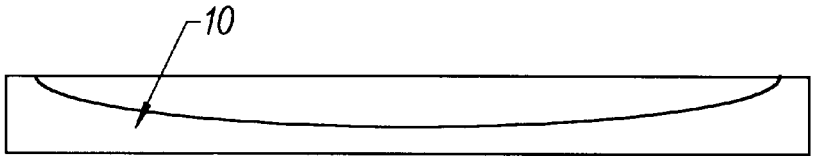
FIG. 5 is an end view of a grooved, inclined plane for a Congreve-style clock according to the invention.

FIG. 5 is an end view of a grooved, inclined plane for a Congreve-style clock according to the invention. The cycloid shape may be conveniently approximated by a circular arc of radius r, in which case the path of the ball is similar to that of a pendulum of length r. The inclination of the ramp effectively decreases the force of gravity on the ball by the cosine of the angle of the plane. Thus, the time required for the ball to traverse a half arc is approximately:

$$\pi\sqrt{\frac{r}{(G\cos A)}} \tag{3}$$

Where G is the acceleration due to gravity and A is the inclination of the plane. If a plane cut with such groove is used in place of a straight-grooved pane in a Congreve-style clock, the clock keeps more accurate time.

Although the invention is described herein with reference to the preferred embodiment, one skilled in the art will readily appreciate that other applications may be substituted for those set forth herein without departing from the spirit and scope of the present invention. Accordingly, the invention should only be limited by the Claims included below.

What is claimed is:

1. In a Congreve-style clock including a timing element, said timing element comprising:

a ball;

an inclined plane; and a plurality of grooves formed on said plane;

wherein said ball traverses each groove to travel along a path defined by said groves, and wherein the depth of each groove in said inclined plane varies along it length so that the path of said ball approximates a cycloid on each traversal.

2. The timing element of claim 1, wherein said grooves provide alternating paths that overlap such that the distance that said ball travels varies with the speed of said ball.

3. The timing element of claim 1, wherein increased friction along said path causes said ball to move more slowly but follow a shorter path, wherein decreased friction along said path causes said ball to travel more quickly but follow a longer path; and wherein the time required to reach a bottom portion of the inclined plane remains the same.

4. The timing element of claim 1, wherein the shape of said cycloid shape is approximated by a circular arc of radius r, such that the path of said ball is similar lo that of a pendulum of length r.

5. The timing element of claim 4, wherein inclination of said plane defines a ramp, such that said inclination decreases the force of gravity on said ball by the cosine of the angle of inclination of said plane.

6. The timing element of claim 5, wherein the time required for said ball to traverse a half arc is approximately:

$$\pi\sqrt{\frac{r}{(G\cos A)}} \tag{3}$$

where G is the acceleration due to gravity and A is the inclination of the plane.

7. In a Congreve-style clock including a timing element, said timing element comprising:

a ball;

an inclined plane; and a plurality of grooves formed on said plane;

wherein said ball traverses each groove to travel along a path defined by said grooves, and wherein the depth of each groove in said inclined plane varies along its length so that the path of said ball approximates a cycloid on each traversal;

wherein said grooves provide alternating paths that overlap such that the distance that said ball travels varies with the speed of said ball; and wherein increased friction along said path causes said ball to move more slowly but follow a shorter path, wherein decreased friction along said path causes said ball to travel more quickly but follow a longer path; and wherein the time required to reach a bottom portion of the inclined plane remains the same.

8. A timing element, comprising:

an inclined plane;

a plurality of grooves formed in said plane;

wherein a ball traversing each groove travels along a path defined by said grooves, and wherein the depth of each groove in said inclined plane varies along its length so that the path of said ball approximates a cycloid on each traversal.

9. In a Congreve-style clock including a timing element, a timing method comprising the steps of:

traversing a plurality of grooves formed on an inclined plan with a ball;

wherein said ball traverses each groove to travel along a path defined by said grooves, and wherein the depth of each groove in said inclined plane varies along its length so that the path of said ball approximates a cycloid on each traversal;

wherein said grooves provide alternating paths that overlap such that the distance that said ball travels varies with the speed of said ball; and wherein increased friction along said path causes said ball to move more slowly but follow a shorter path, wherein decreased friction along said path causes said ball to travel more quickly but follow a longer path; and wherein the time required to reach a bottom portion of the inclined plane remains the same.

* * * * *